US006360823B1

(12) United States Patent
Ranson et al.

(10) Patent No.: US 6,360,823 B1
(45) Date of Patent: Mar. 26, 2002

(54) APPARATUS AND METHOD FOR PERFORMING DOWNHOLE MEASUREMENTS

(75) Inventors: Aaron Ranson; Jose Zapico, both of Edomiranda; Douglas A. Espin, Cavacas; Mariela G. Araujo, San Antonio, all of (VE)

(73) Assignee: Intevep, S.A. (VE)

( * ) Notice: Subject to any disclaimer, the term of this patent is extended or adjusted under 35 U.S.C. 154(b) by 0 days.

(21) Appl. No.: 09/619,813

(22) Filed: Jul. 20, 2000

(51) Int. Cl.[7] ..... E21B 23/00; E21B 47/00; G01V 3/18

(52) U.S. Cl. ..... 166/381; 166/250.11; 166/66; 175/40; 73/152.55

(58) Field of Search ..... 166/66, 72, 250.01, 166/250.11, 255.1, 381; 175/40, 44, 45, 46, 48, 50; 73/152.55, 152.28, 152.02

(56) References Cited

U.S. PATENT DOCUMENTS 3,086,167 A * 4/1963 Chaney et al. ..... 324/327
3,260,112 A * 7/1966 Godbey et al. ..... 374/104
3,651,530 A * 3/1972 Schultz ..... 15/104.061
3,673,629 A * 7/1972 Casey et al. ..... 15/104.061
4,916,312 A * 4/1990 Ellis et al. ..... 250/260
5,181,571 A * 1/1993 Mueller et al. ..... 166/381
5,565,624 A * 10/1996 Debaisne et al. ..... 73/152.02
5,839,508 A * 11/1998 Tubel et al. ..... 166/65.1
6,145,378 A * 11/2000 McRobbie et al. ..... 73/490
6,170,573 B1 * 1/2001 Brunt et al. ..... 166/153
6,234,257 B1 * 5/2001 Ciglenec et al. ..... 175/50
6,241,028 B1 * 6/2001 Bijleveld et al. ..... 175/40

FOREIGN PATENT DOCUMENTS

DE 3843176 A1 * 6/1990 ..... B65G/51/36
FR 2677501 * 12/1992 ..... H02G/1/08

* cited by examiner

*Primary Examiner*—David Bagnell
*Assistant Examiner*—Jennifer H Gay
(74) *Attorney, Agent, or Firm*—Bachman & LaPointe, P.C.

(57) ABSTRACT

An apparatus for performing a function in a flowing fluid includes an apparatus body and a drag member associated with the apparatus body. The drag member is configurable between drag configuration for moving with the fluid wherein the apparatus has a first drag and a reduced drag configuration for moving against the fluid wherein the apparatus has a second drag which is less than the first drag.

19 Claims, 1 Drawing Sheet

APPARATUS AND METHOD FOR PERFORMING DOWNHOLE MEASUREMENTS

BACKGROUND OF THE INVENTION

The invention relates to an apparatus and method for performing a function in a flowing fluid and, more particularly, to a method and apparatus for performing downhole measurements and the like.

Oil and gas wells are drilled into oil and gas bearing formations so as to produce such oil and gas for use as fuel and numerous other products. In the course of such drilling and production, it is critical to obtain information as to the formations drilled through, as well as fluids within the well. Conventional methods for obtaining desirable information include core sampling from the well, measurement while drilling, logging while drilling and the like. These methods all provide critical information which is helpful in optimizing drilling and production activities.

Conventional equipment for obtaining this information includes electrical wiring and/or optical fiber in substantial lengths, for example equivalent to the depth of the well, and various other sensors and analytical equipment. This equipment creates substantial cost and in some cases can require re-completion of a well for installation, particularly to install sensors in appropriate positions.

Conventional equipment is frequently accompanied by poor robustness or reliability, which leads to poor performance over time. Sensors and other equipment are frequently not reusable and are expensive to install and/or replace.

It is clear that the need remains for improved methods and equipment for obtaining downhole measurements.

It is therefore the primary object of the present invention to provide an apparatus for obtaining downhole measurements which addresses the foregoing disadvantages of the prior art.

It is a further object of the present invention to provide a method for obtaining downhole measurements.

Other objects and advantages of the present invention will appear hereinbelow.

SUMMARY OF THE INVENTION

In accordance with the present invention, the foregoing objects and advantages have been readily attained.

In accordance with the invention, an apparatus is provided for performing a function in a flowing fluid, which apparatus comprises an apparatus body and a drag member associated with said apparatus body and configurable between a drag configuration for moving with said fluid wherein said apparatus has a first drag, and a reduced drag configuration for moving against said fluid wherein said apparatus has a second drag which is less than said first drag.

In further accordance with the present invention, a method is provided for positioning an apparatus relative to a flowing fluid, which method comprises the steps of providing a flow of fluid; providing an apparatus comprising an apparatus body and a drag member associated with said apparatus body and configurable between a drag configuration having a first drag for moving with said flow of fluid and a reduced drag configuration having a second drag for moving against said flow of fluid wherein said second drag is less than said first drag; positioning said apparatus in said flow of fluid with said drag member in said reduced drag configuration whereby said apparatus moves against said flow of fluid; and configuring said drag member in said drag configuration whereby said apparatus moves with said flow of fluid.

The apparatus is advantageously provided with sensors for making desired measurements and can be controlled from a surface location.

BRIEF DESCRIPTION OF THE DRAWINGS

A detailed description of preferred embodiments of the present invention follows, with reference to the attached drawings, wherein.

DETAILED DESCRIPTION

The invention relates to an apparatus and method for performing a function in a flowing fluid, and particularly to an apparatus and method for obtaining downhole measurements in a subterranean well environment.

In accordance with the present invention, an apparatus and a method for using the apparatus are provided which readily allow for obtaining various desirable measurements in a flowing fluid, for example in a producing oil and gas well, without the conventional disadvantages associated with utilizing equipment attached to wires such as conventional logs, and without the further disadvantages accompanied by installing permanent sensors in downhole locations.

Figure 1:
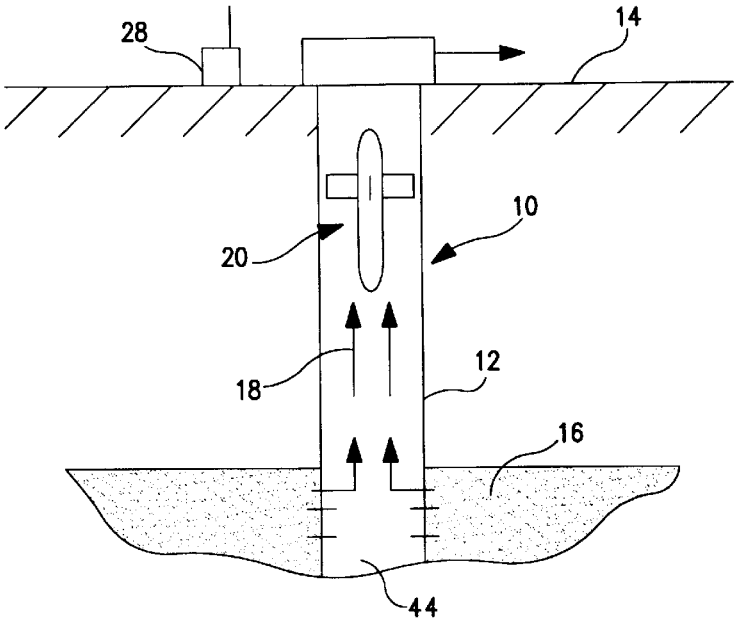
FIG. 1 schematically illustrates an oil well drilled to a producing formation and an apparatus positioned therein in accordance with the present invention.

FIG. 1 schematically illustrates a typical oil producing well 10 which includes a production tubing 12 positioned from a surface location 14 to a subterranean formation 16 for producing fluid (schematically illustrated by arrows 18) from formation 16 to surface location 14 as desired. FIG. 1 also illustrates apparatus 20 in accordance with the invention which can advantageously be positioned within production tubing 12 and configured to travel from surface location 14 to deeper locations within production tubing 12, and back to surface location 14 when desired. Apparatus 20 can be utilized to obtain any and all desired measurements from various downhole locations along production tubing 12 as desired. It should of course be appreciated that apparatus 20 is shown in FIG. 1 with exaggerated size so as to better illustrate the present invention.

Figure 2:
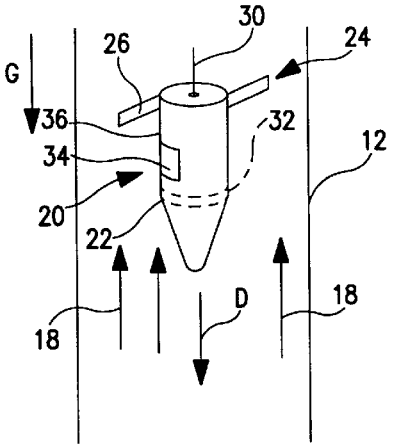
FIG. 2 illustrates an embodiment of the present invention in a reduced drag configuration for descending in a well.
Figure 3:
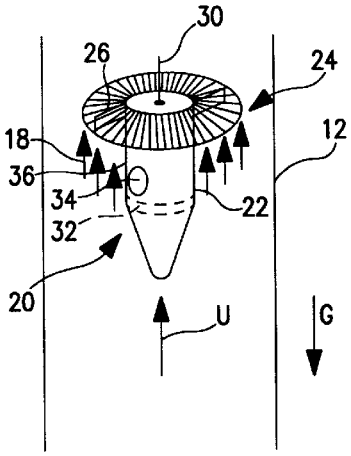
FIG. 3 illustrates an embodiment of the present invention in a drag configuration for moving upwardly in a well.

Turning to FIGS. 2 and 3, apparatus 20 in accordance with the present invention is further illustrated.

Apparatus 20 in accordance with the present invention preferably includes an apparatus body 22 for housing the various desired components of apparatus 20 as will be further discussed below. Apparatus body 22 is preferably a substantially elongate member having a longitudinal axis. The exterior surface of apparatus body 22 is preferably designed so as to provide a minimum amount of drag to fluids flowing past apparatus 20, or through which apparatus 20 is moving. For example, body 22 may be substantially cylindrical with tapered or rounded ends. Of course, other shapes are also suitable.

Apparatus 20 also includes a drag member 24 which is configurable between a drag configuration (illustrated in FIG. 3) and a reduced drag configuration (illustrated in FIG. 2). This is further described below.

In a producing well, fluids being produced typically include hydrocarbons, water and any other materials which might be encountered in the particular subterranean formation from which fluids are produced. These fluids flow upwardly through production tubing 12 to surface location 14 as desired. This flow may be driven by pressure within formation 16, and/or various other additional forces such as pumps, gas lift, and the like. In accordance with the present invention, apparatus 20 is adapted and configured such that, in the reduced drag configuration of FIG. 2, the force of gravity is sufficient to pull apparatus 20 downwardly through the upwardly flowing fluid so as to move apparatus 20 against the flow of fluid and in a downward direction within production tubing 12 to deeper locations in the well. This advantageously allows apparatus 20 to be positioned at downhole locations as desired.

When it is desired to return apparatus 20 to the surface, drag member 24 is configured to the drag configuration of FIG. 3, which has increased drag as compared to the reduced drag configuration, and which results in the drag force applied by upwardly flowing fluid overcoming the force of gravity and lifting apparatus 20 through production tubing 12 toward surface location 14 as desired. This advantageously allows for apparatus 20 to be positioned at any desired downhole location along production tubing 12, within flowing fluid 18, so as to obtain any desired measurements and the like without the need for conventional logging equipment and/or permanently installed sensors.

Drag member 24 in accordance with the present invention may advantageously be provided as a plurality of substantially planar members 26 which can be positioned substantially parallel to the longitudinal axis of apparatus body 22 as shown in FIG. 2 so as to provide for a reduced drag configuration. In this configuration, the force of gravity G overcomes the drag of upwardly flowing fluid 18 resulting in downward motion D of apparatus 20 as desired. Planar members 26 can be configured or positioned, in this case through rotation, to a substantially horizontal position with respect to the longitudinal axis of apparatus body 22 as shown in FIG. 3 so as to provide an increased drag configuration wherein the force of upwardly flowing fluid 18 overcomes the force of gravity G resulting in upward motion U as shown in FIG. 3.

Positioning of drag member 24 between the drag configuration of FIG. 3 and the reduced drag configuration of FIG. 2 may advantageously be accomplished from a remote location, for example using a preferably wireless control member or transmitter 29 (see FIG. 1) positioned at surface location 14 for issuing commands to apparatus 20. Commands can be received, for example through a receiver 30 on apparatus 20, for actuating a motor or motors (not shown) within apparatus body 22 for rotating planar members 26 between the desired positions.

FIGS. 2 and 3 illustrate planar members 26 positioned in a vertical position (FIG. 2) and in a horizontal position (FIG. 3) representing the minimum and maximum drag positions, respectively. It should be appreciated that planar member 26 could be partially pivoted between the positions of FIGS. 2 and 3 so as to obtain an intermediate drag position which could be utilized, in combination with a sensor for detecting speed of movement within production tubing 12, to allow for obtaining an equilibrium position wherein apparatus 20 maintains substantially the same position within production tubing 12 for example if a particular measurement must be taken that requires being stationary at a particular level in the well for an extended length of time. By monitoring speed and position of apparatus 20, and adjusting drag member 24 appropriately, apparatus 20 can be positioned to any location within a well, and returned to the surface when desired. Further, the speed of descent and ascent can be controlled by changing the angle of the drag member to increase or decrease drag.

As set forth above, it is a particular advantage of the present invention to be able to obtain various desirable downhole measurements without the need for conventional equipment such as fixed installation sensors and/or wired or otherwise connected devices. Thus, apparatus 20 is typically provided having one or more sensors or other analytical devices positioned on or within body 20 as schematically illustrated at 32 for example to obtain measurements of desired conditions. Such conditions may be fluid related conditions including pressure, temperature, density, viscosity, water content, composition, multiphase flow and the like. Additional information which may be desirable to obtain utilizing sensors 32 includes speed of movement of apparatus 20, position of apparatus 20 within production tubing 12, proximity of bottom 44 of well 10, and the like. The actual structure and/or circuitry of such sensors is well known to a person of ordinary skilled in the art and is therefore not described herein.

Apparatus 20 in accordance with the present invention includes various electronic devices as described above. Such devices includes sensor 32 and one or more motors (not shown) for driving planar members 26 of drag member 24. A power source for these devices is preferably provided in the form of a rechargeable battery 34, which can ideally be positioned within apparatus body 22. Battery 34 may advantageously be rechargeable such that apparatus 20 can be recharged once it is retrieved at surface location 14. In accordance with a further preferred embodiment of the present inventions apparatus 20 may be provided having a fluid actuated charger or generator 36 operatively associated with rechargeable battery 34 and exposed to flowing fluid 18 within production tubing 12 so as to allow for potentially continuous recharging of battery member 34 if desired. The specific components and circuitry of battery 34 and charger 36 are also well known to a person of ordinary skill in the art and are therefore not included herein. For example, drag member 24 could be adapted to convert fluid momentum into rotation of drag member 24 as shown in FIG. 3. This rotation relative to the rest of apparatus 20 could be used to operate charger/generator 36. In this embodiment, stabilizing fins or other structure may be desired to prevent rotation of body 22 along with drag member 24. Of course, other configurations and structures could likewise be used to convert fluid momentum into stored energy for operating apparatus 20 as desired.

Apparatus 20 may advantageously be provided with a control member programmed to provide for particular desirable functions. For example, apparatus 20 may include a control member programmed to sense when battery 34 has reached a low power state at which point drag member 24 could be automatically positioned to the drag position of FIG. 3 so as to allow for recovery of apparatus 20 at surface location 14 and recharging of battery 34 and the like.

The control member may also advantageously be adapted to utilize particular information received by sensors 32 to enhance the downhole measurement ability of apparatus 20. For example, the control member of apparatus 20 may be adapted so as to detect the approach of the bottom 44 of production tubing 12 so that drag member 24 can be properly positioned to increase drag and slow descent of apparatus 20, thereby avoiding a potentially damaging collision with bottom 44 of production tubing 12.

Still further, the control member of apparatus 20 may advantageously be adapted so as to detect abnormalities in one or more fluid conditions and automatically configure drag member 24 to remain at the particular location for an extended period of time obtain additional measurements.

Apparatus 20 may also be provided with capacity for carrying one or more additives such as cement for local repairs, plugging material for selectively closing off one or more zones, or any other material which could advantageously be deployed within production tubing 12 by apparatus 20 if desired. In this embodiment, the control member for apparatus 20 would of course control deployment of such material as well.

In accordance with the present invention, apparatus 20 is provided which is configurable to positions which increase and decrease the drag coefficient at the fluid-body interface between apparatus body 22 and flowing fluid 18. The total time-averaged force ($F_D$) exerted by the flow on an object can be written in a dimensionless manner, utilizing frontal area (A) of the object, as follows:

$$C_D = \frac{F_D / A}{\frac{1}{2}\rho V^2}$$

wherein $C_D$ is the drag coefficient and V is fluid velocity.

In the embodiment of FIGS. 2 and 3, drag member 24 operates by increasing and decreasing area A as well as changing local geometry which thereby adjusts the drag coefficient $C_D$.

Through this manipulation, apparatus 20 can be configured to move downwardly within production tubing 12 by the force of gravity, and can be configured to move upwardly with flow 18, utilizing energy provided by flow 18 on drag member 24.

Apparatus 20 in accordance with the present invention will typically be exposed to conditions including temperatures between about 20° C. and about 350° C. and pressures between about 100 psi and about 25000 psi. It is therefore preferable that apparatus body 22 be selected so as to withstand such conditions, and further that components within apparatus body 22 be selected so as to withstand such conditions.

It should also readily be appreciated that communication between apparatus 20 and surface location 12 is accomplished utilizing wireless communications, thereby providing a marked improvement over conventional systems utilizing hardwiring and/or optical cables.

Further, apparatus 20 in accordance with the present invention operates utilizing extremely low energy consumption, and can preferably be provided so as to recharge during use utilizing energy from the fluid.

A typical cycle for use of apparatus 20 in accordance with the present invention will now be described.

Use may typically be commenced by introducing apparatus 20 into well 10 utilizing a "lubricator" or any other port which is suitable for introducing apparatus 20 into production tubing 12 from surface location 14. Once apparatus 20 is within production tubing 12, communication is established between apparatus 20 and control member 28. A diagnostic may then advantageously be performed so as to insure all systems of apparatus 20 are functioning.

Figure 4:
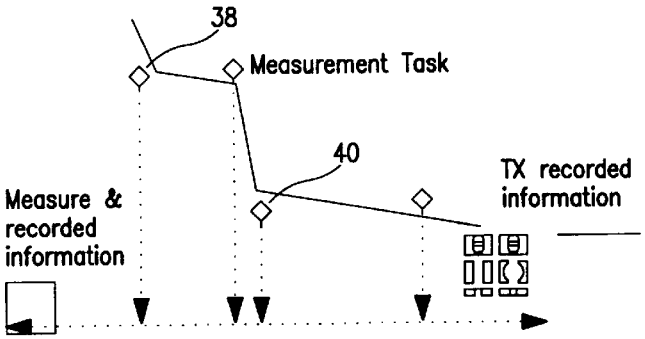
FIG. 4 illustrates a cycle path of use of the apparatus of the present invention for obtaining measurements along the depth of a well.

Assuming that the diagnostic does not indicate any problems, drag member 24 may advantageously be configured to the reduced drag configuration of FIG. 2 and apparatus 20 will begin a smooth falling motion through upwardly flowing fluid 18 as desired. FIG. 4 illustrates schematically a cycle path with vertical position of apparatus 20 plotted over time, and various tasks being accomplished along the way. While apparatus 20 is travelling, various measurements are being taken including those which may be automatically programmed and those which may be requested by an operator at surface location 14. Apparatus 20 is preferably adapted to continuously monitor acceleration so as to maintain speed and acceleration below levels which could cause damage upon impact with production tubing 12 and other well equipment.

Information obtained by apparatus 20 may be stored within apparatus 20, for example in local memory, and/or may be transmitted to control member 28 at surface location 14.

During descent, should any abnormal situation be detected, apparatus 20 may be programmed and/or instructed to take an appropriate action. For example, as illustrated at point 38 in FIG. 4, it may be desirable to slow or stop descent of apparatus 20 in production tubing 12 so as to perform a further specific measurement task and the like. Upon completion, drag member 24 can again be configured to the reduced drag configuration so as to continue descent as illustrated. Upon reaching a further downhole point, for example point 40 as illustrated in FIG. 4, an additional task may be performed. Further, if it is now detected that apparatus 20 has reached a close proximity to the bottom of the well, apparatus 20 may advantageously be configured to the drag position of FIG. 3 for ascent through production tubing 12 back to surface location 14 as desired.

It should be readily appreciated that apparatus 20 and the use of same provide for substantial advantages as compared to conventional systems and methods for obtaining downhole measurements. Specifically, apparatus 20 avoids the need for permanent installations downhole, and also avoids the need for wired connections or optical connections extended over substantial lengths such as the entire depth of a well and the like.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. An apparatus for performing a function in a flowing fluid, comprising:

an apparatus body comprises an elongated member having a longitudinal axis; and a drag member associated with said apparatus body and configurable between a drag configuration for moving with said fluid wherein said apparatus has a first drag and a reduced drag configuration for moving against said fluid wherein said apparatus has a second drag which is less than said first drag, wherein said drag member comprises means positionable relative to said apparatus body and said longitudinal axis between said drag configuration wherein said means extends away from said longitudinal axis and said reduced drag configuration wherein said means is substantially parallel to said longitudinal axis.

2. The apparatus according to claim 1, wherein said means comprises a substantially planar member having a planar surface positionable relative to said apparatus body between said drag configuration and said reduced drag configuration.

3. The apparatus according to claim 1, further comprising a control member remotely associated with said drag member for configuring said drag member between said drag configuration and said reduced drag configuration.

4. The apparatus according to claim 1, further comprising a rechargeable power source within said apparatus body and a fluid actuated charger positioned on said apparatus body for charging said power source when said apparatus is exposed to said flowing fluid.

5. The apparatus according to claim 1, further comprising a sensor member mounted relative to said apparatus body for sensing at least one condition of said flowing fluid selected from the group consisting of pressure, temperature, density, viscosity, water content, composition and multiphase flow.

6. The apparatus according to claim 5, further comprising a transmitter member mounted to said apparatus body and a receiver positioned remotely relative to said apparatus body, said transmitter being adapted for transmitting said at least one condition to said receiver.

7. The apparatus according to claim 5, further comprising a storage member mounted to said apparatus body for storing said at least one condition.

8. The apparatus according to claim 1, further comprising a position sensor member mounted to said apparatus body for sensing position of said apparatus.

9. The apparatus according to claim 1, wherein said drag member is configurable to at least one partial drag configuration between said drag configuration and said reduced drag configuration whereby drag relative to said fluid can be adjusted.

10. A method for positioning an apparatus relative to a flowing fluid, comprising the steps of:

providing a flow of fluid;

providing an apparatus comprising an apparatus body and a drag member associated with said apparatus body and configurable between a drag configuration having a first drag for moving with said flow of fluid and a reduced drag configuration having a second drag for moving against said flow of fluid wherein said second drag is less than said first drag;

positioning said apparatus in said flow of fluid with said drag member in said reduced drag configuration whereby said apparatus moves against said flow of fluid;

configuring said drag member in said drag configuration whereby said apparatus moves with said flow of fluid;

selectively controlling the position of the apparatus in said flow of fluid; and measuring with said apparatus at least one condition of said flowing fluid at said selected position.

11. The method according to claim 10, wherein said flow of fluid is a substantially vertical flow of fluid.

12. The method according to claim 10, wherein said flow of fluid is in a directional substantially opposite to gravitational forces on said apparatus.

13. The method according to claim 10, wherein said flow of fluid is in a well producing fluid from a subterranean formation to a surface location.

14. The method according to claim 13, further comprising controlling the configuration of said drag member from said surface location when said apparatus is in said well.

15. The method according to claim 13, further comprising the step of measuring, with said apparatus, at least one condition of said flowing fluid selected from the group consisting of pressure, temperature, density, viscosity, water content, composition and multiphase flow.

16. The method according to claim 15, further comprising the step of transmitting said at least one condition from said apparatus in said well to said surface location.

17. The method according to claim 10, further comprising the step of measuring, with said apparatus, at least one condition of said flowing fluid selected from the group consisting of pressure, temperature, density, viscosity, water content, composition and multiphase flow.

18. The method according to claim 17, further comprising the step of storing said at least one condition in said apparatus.

19. The method according to claim 10, further comprising the step of detecting with said apparatus a position of said apparatus relative to said flow of fluid.

* * * * *